US012031256B2

(12) United States Patent
So et al.

(10) Patent No.: US 12,031,256 B2
(45) Date of Patent: Jul. 9, 2024

(54) CLOTHES TREATMENT APPARATUS

(71) Applicant: WUXI LITTLE SWAN ELECTRIC CO., LTD., Wuxi (CN)

(72) Inventors: Jin Woo So, Wuxi (CN); Yugao Xu, Wuxi (CN)

(73) Assignee: WUXI LITTLE SWAN ELECTRIC CO., LTD, Wuxi (CN)

( * ) Notice: Subject to any disclaimer, the term of this patent is extended or adjusted under 35 U.S.C. 154(b) by 329 days.

(21) Appl. No.: 17/603,948

(22) PCT Filed: Dec. 24, 2019

(86) PCT No.: PCT/CN2019/128056
§ 371 (c)(1),
(2) Date: Oct. 15, 2021

(87) PCT Pub. No.: WO2021/047109
PCT Pub. Date: Mar. 18, 2021

(65) Prior Publication Data

US 2022/0307183 A1 Sep. 29, 2022

(30) Foreign Application Priority Data

Sep. 10, 2019 (CN) ..... 201910854432.1

(51) Int. Cl.

| | |
|---|---|
| ***D06F 29/02*** | (2006.01) |
| ***D06F 29/00*** | (2006.01) |
| ***D06F 39/08*** | (2006.01) |
| ***D06F 58/24*** | (2006.01) |

(52) U.S. Cl.
CPC ..... *D06F 29/02* (2013.01); *D06F 29/005* (2013.01); *D06F 39/085* (2013.01); *D06F 58/24* (2013.01)

(58) Field of Classification Search
CPC ..... D06F 29/02
See application file for complete search history.

(56) References Cited

FOREIGN PATENT DOCUMENTS

| | | | |
|---|---|---|---|
| CN | 101736566 | A | 6/2010 |
| CN | 103898727 | A | 7/2014 |
| CN | 104652085 | A | 5/2015 |
| CN | 204358931 | U | 5/2015 |
| CN | 105483970 | A | 4/2016 |
| CN | 106319878 | A | 1/2017 |

(Continued)

OTHER PUBLICATIONS

International Search Report of PCT No. PCT/CN2019/128056.

(Continued)

*Primary Examiner* — Jason Y Ko
(74) *Attorney, Agent, or Firm* — Anova Law Group, PLLC

(57) ABSTRACT

Disclosed is a clothes treatment apparatus, comprising a clothes drying device, a first drainage pipe, a second drainage pipe, a drainage pump and a controller, wherein the clothes drying device is provided with a water accumulation tank; an inlet of the first drainage pipe is in communication with the water accumulation tank; a water outlet of the drainage pump is in communication with the second drainage pipe; and a water inlet of the drainage pump is in communication with the water accumulation tank. By means of the additional provision of the drainage pump and the second drainage pipe, the clothes treatment apparatus can discharge water in the water accumulation tank in a timely manner, and the drainage performance of the clothes drying device is improved.

15 Claims, 5 Drawing Sheets

(56) References Cited

FOREIGN PATENT DOCUMENTS

| | | | |
|---|---|---|---|
| CN | 106555308 | A | 4/2017 |
| CN | 107523959 | A | 12/2017 |
| CN | 108239865 | A | 7/2018 |
| CN | 109972345 | A | 7/2019 |
| CN | 110055710 | A | 7/2019 |
| CN | 110144697 | A | 8/2019 |
| CN | 110565319 | A | 12/2019 |
| EP | 2065505 | A1 | 6/2009 |
| EP | 2586904 | A1 | 5/2013 |
| EP | 2746450 | A1 | 6/2014 |
| JP | 2001046788 | A | 2/2001 |
| KR | 101921181 | B1 | 2/2019 |
| WO | 2015118585 | A1 | 8/2015 |
| WO | 2019052344 | A1 | 3/2019 |
| WO | 2019141065 | A1 | 7/2019 |

OTHER PUBLICATIONS

Supplementary European Search Report mailed May 18, 2022 for EP application No. 19945153.5.
First OA of CN Application No. 201910854432.1.

CLOTHES TREATMENT APPARATUS

CROSS-REFERENCES TO RELATED APPLICATIONS

The present disclosure is a national phase application of International Application No. PCT/CN2019/128056, filed on Dec. 24, 2019, which claims the priority to Chinese Patent Application No. 201910854432.1, filed on Sep. 10, 2019, the entireties of which are herein incorporated by reference.

FIELD

The disclosure relates to the field of laundry cleaning, and in particular to a laundry treatment apparatus.

BACKGROUND

Taking a combined laundry washer-dryer as an example, the combined laundry washer-dryer solves the problem of washing and drying laundry simultaneously, and condensed water in a laundry dryer is discharged through a condensed water drain pipe. Generally, the condensed water generated in the laundry drying process of the laundry dryer is less, and a pipe diameter of an open drain pipe is also smaller. When the laundry dryer is equipped with functions such as cylinder self-cleaning and the like, the condensed water drain pipe may not discharge a large amount of water in the laundry dryer in time, which brings a hidden danger to the laundry dryer.

SUMMARY

In view of the above, embodiments of the disclosure are intended to provide a laundry treatment apparatus capable of discharging water in time.

To achieve the above object, the embodiment of the disclosure provides a laundry treatment apparatus including a laundry drying device, a first drain pipe, a second drain pipe and a drain pump. The laundry drying device is provided with a water accumulation tank. An inlet of the first drain pipe is in communication with the water accumulation tank. A water outlet of the drain pump is in communication with the second drain pipe, and a water inlet of the drain pump is in communication with the water accumulation tank.

Further, the laundry treatment apparatus includes a controller configured to control the drain pump to be opened when a water level in the water accumulation tank is higher than a first preset water level, so that water in the water accumulation tank is discharged from the water accumulation tank through the first drain pipe and the second drain pipe. Herein, the first preset water level is higher than a height of the inlet of the first drain pipe.

Further, the controller is configured to control the drain pump to be opened after the water level in the water accumulation tank reaches the first preset water level for a first preset time.

Further, the controller is configured to control the drain pump to be closed when the water level in the water accumulation tank is lower than a second preset water level. Herein, the second preset water level is higher than the height of the inlet of the first drain pipe, and the first preset water level is equal to or higher than the second preset water level.

Further, the controller is further configured to control the drain pump to be closed or to be remained in an open state according to the water level in the water accumulation tank after the drain pump is opened for a second preset time.

Further, the inlet of the first drain pipe is located at a lowest position of the water accumulation tank.

Further, a flow area of the second drain pipe is greater than a flow area of the first drain pipe.

Further, the laundry treatment apparatus includes a liquid level detecting unit for detecting the water level in the water accumulation tank. The liquid level detecting unit is electrically connected with the controller. The controller is configured to control the drain pump to be opened or to be closed according to a detection result of the liquid level detecting unit.

Further, the laundry treatment apparatus includes a washing device, a third drain pipe and a main drain pipe. The washing device is arranged below the laundry drying device. Water in the washing device is in communication with the main drain pipe through the third drain pipe. The first drain pipe, the second drain pipe and the third drain pipe are in communication with the main drain pipe.

Further, the laundry treatment apparatus includes a multi-channel pipe. The multi-channel pipe includes a first inlet connected with the first drain pipe, a second inlet connected with the second drain pipe, a third inlet connected with the third drain pipe, and a main outlet connected with the main drain pipe.

Further, each of a height of the first inlet and a height of the second inlet is higher than a height of the third inlet.

Further, the multi-channel pipe is located at an edge of a top of the washing device.

Further, the multi-channel pipe includes a pipe body and a partition plate arranged in the pipe body. The partition plate divides a space in the pipe body into a first flow channel and a second flow channel. The third inlet forms an inlet of the first flow channel, and the first inlet and the second inlet form an inlet of the second flow channel.

Further, the partition plate extends to an end of the pipe body connected with the main drain pipe.

Further, a flow area of the first flow channel is greater than or equal to a flow area of the third drain pipe.

The laundry treatment apparatus of the embodiment of the disclosure is provided with the drain pump and the second drain pipe, and the drain pump has an emergency standby function. When the laundry drying device enables functions such as cylinder self-cleaning and the like, a large amount of cleaning water enters the water accumulation tank, and the first drain pipe may not discharge the water in the water accumulation tank in time, which may cause the water level in the water accumulation tank to continuously rise. Or, when a water intake faucet on the laundry drying device fails, the water flow of the water intake faucet continuously enters the laundry drying device. If the water flow is not discharged in time, the water flow in the laundry drying device may soak electrical components, which causes the electrical failure of the laundry treatment apparatus, and the water flow in the laundry drying device also overflows into the indoor space. In the embodiment of the disclosure, when the water level in the water accumulation tank rises, the drain pump and the second drain pipe can discharge the water in the water accumulation tank in time, improving the drainage performance of the laundry drying device.

DETAILED DESCRIPTION OF THE DISCLOSURE

It should be noted that the embodiments of the disclosure may be combined with each other without conflict, and the description of the detailed description should be understood as an explanation of the disclosure and should not be construed as unduly limiting the disclosure.

Figure 1:
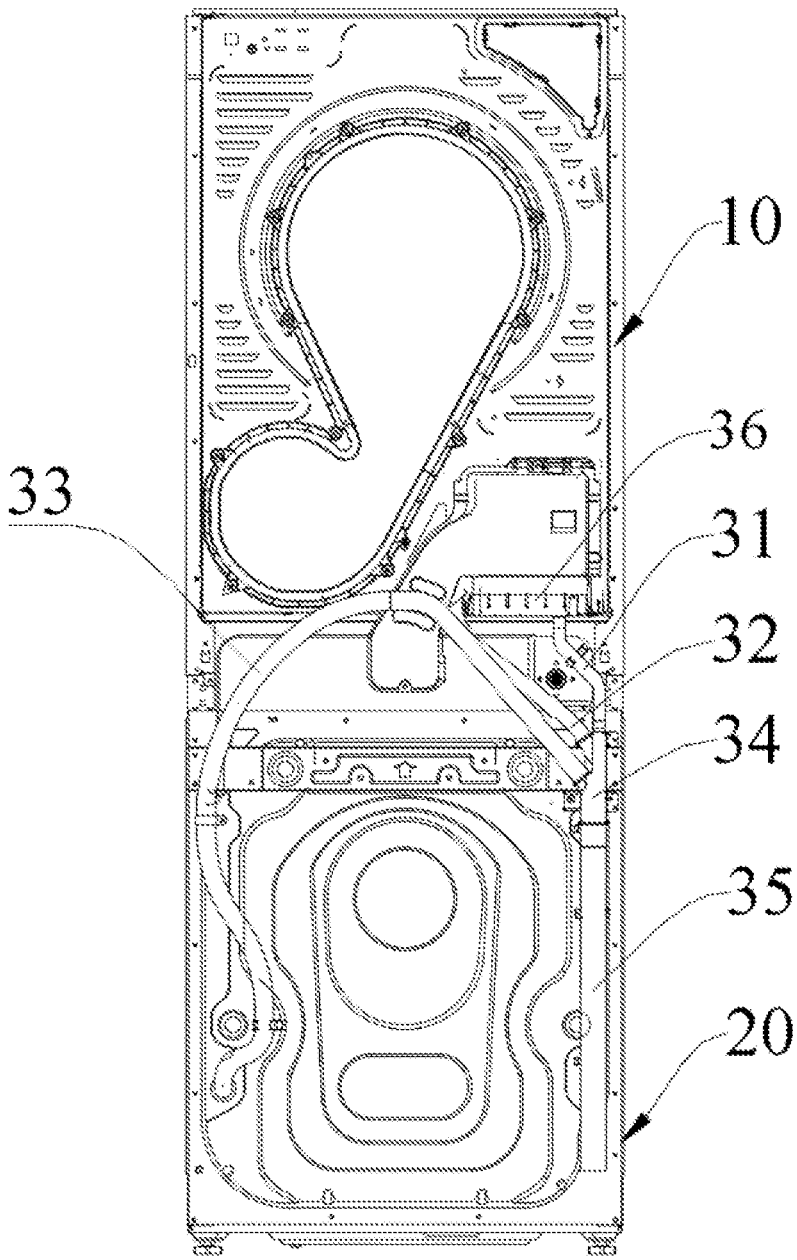
FIG. 1 is a schematic diagram of a laundry treatment apparatus according to an embodiment of the disclosure, in which a part of a decorative housing of the laundry treatment apparatus is omitted.

In the description of the disclosure, "upper", "lower", "left", "right", "front" and "rear" orientations or positional relationships are based on an orientations or positional relationships shown in FIG. 1. It should be understood that these orientation terms are intended solely for ease of describing the disclosure and simplifying the description, and are not intended to indicate or imply that the devices or elements must have a particular orientation, be constructed and operated in a particular orientation. Therefore, these orientation terms are not to be understood as limiting the disclosure.

In an embodiment of the disclosure, a flow area refers to the cross-sectional area of fluid passing through the pipe body.

Figure 2:
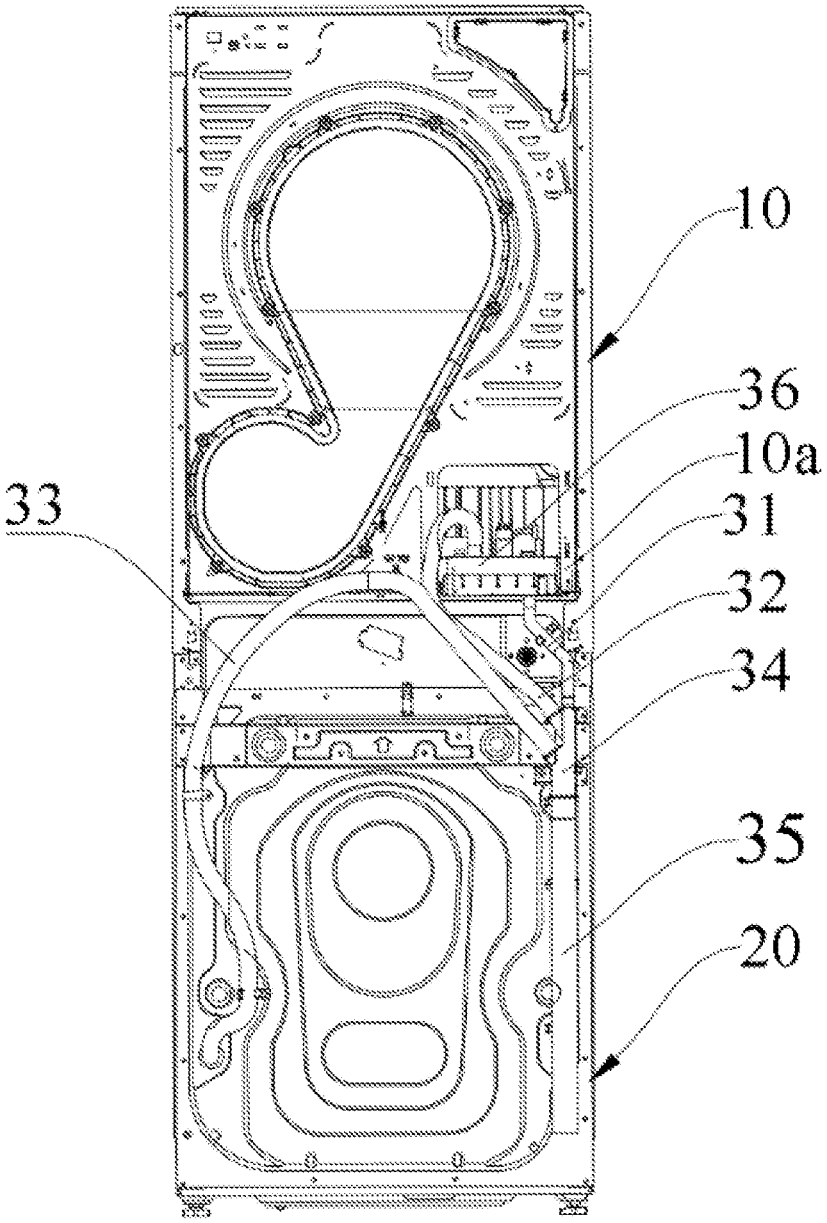
FIG. 2 is a partial cross-sectional view of the laundry treatment apparatus shown in FIG. 1.
Figure 5:
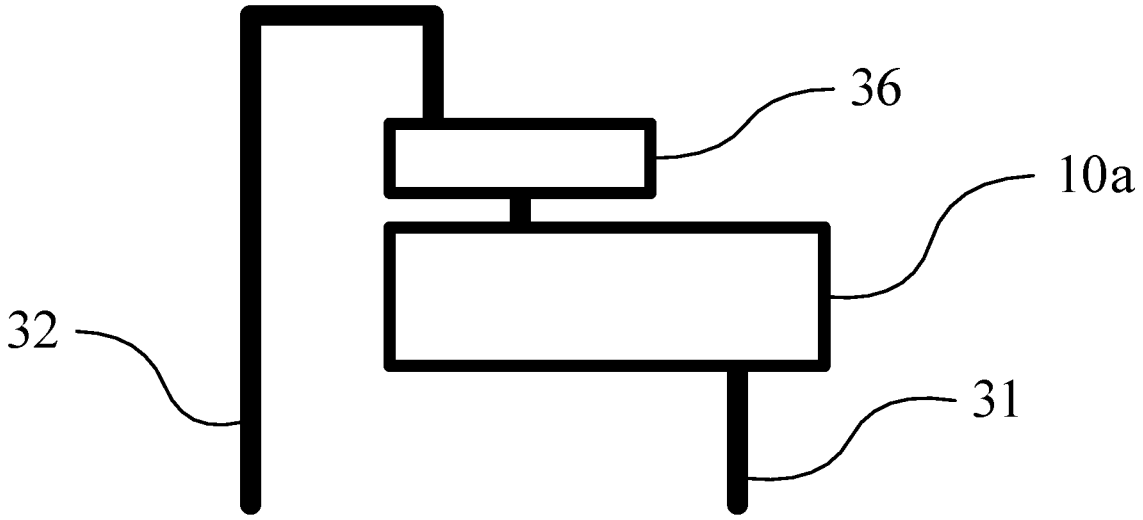
FIG. 5 schematically shows a portion of the laundry treatment apparatus consistent with the disclosure.

Referring to FIG. 1 and FIG. 2, an embodiment of the disclosure provides a laundry treatment apparatus including a laundry drying device 10, a first drain pipe 31, a second drain pipe 32 and a drain pump 36. The laundry drying device 10 is provided with a water accumulation tank 10*a*, the water accumulation tank 10*a* is configured for accumulating condensed water generated in the laundry drying process, or for accumulating cleaning water generated when the laundry drying device 10 enables the cylinder self-cleaning mode, and the like. As shown in FIGS. 1, 2, and 5, an inlet of the first drain pipe 31 is in communication with the water accumulation tank 10*a*, and the first drain pipe 31 is in a normally open state. The water accumulation tank 10*a* can always discharge the water through the first drain pipe 31 as long as a water level in the water accumulation tank 10*a* is higher than a height of the inlet of the first drain pipe 31. A water outlet of the drain pump 36 is in communication with the second drain pipe 32, and a water inlet of the drain pump 36 is in communication with the water accumulation tank 10*a*.

According to the laundry treatment apparatus of the embodiment of the disclosure, the drain pump 36 has an emergency standby function. When the laundry drying device 10 enables functions such as cylinder self-cleaning and the like, a large amount of cleaning water enters the water accumulation tank 10*a*, and the first drain pipe 31 may not discharge the water in the water accumulation tank 10*a* in time, which may cause the water level in the water accumulation tank 10*a* to continuously rise. Or, when a water intake faucet on the laundry drying device fails, the water flow of the water intake faucet continuously enters the laundry drying device. If the water flow is not discharged in time, the water flow in the laundry drying device may soak electrical components, which causes the electrical failure of the laundry treatment apparatus, and the water flow in the laundry drying device also overflows into the indoor space. In the embodiment of the disclosure, when the water level in the water accumulation tank 10*a* rises, the drain pump 36 and the second drain pipe 32 can discharge the water in the water accumulation tank 10*a* in time, improving the drainage performance of the laundry drying device.

The drain pump 36 may be in an open state all the time or may be selectively opened according to a height of the water level. In the embodiment of the disclosure, the laundry treatment apparatus includes a controller configured to control the drain pump 36 to be opened when the water level in the water accumulation tank 10*a* is higher than a first preset water level, so that water in the water accumulation tank 10*a* is discharged from the water accumulation tank 10*a* through the first drain pipe 31 and the second drain pipe 32. Herein, the first preset water level is higher than a height of the inlet of the first drain pipe 31. That is, when the water level in the water accumulation tank 10*a* is lower than the first preset water level, it means that the water level in the water accumulation tank 10*a* has not reached a warning water level. At this time, the drainage requirement for the water accumulation tank 10*a* may be satisfied through the first drain pipe 31, and the drain pump 36 is in a close state, so that the energy can be saved and the consumption can also be reduced, and unnecessary working noise generated by the drain pump 36 can be avoided. When the water level in the water accumulation tank 10*a* reaches or exceeds the first preset water level, it means that the water level in the water accumulation tank 10*a* has reached the warning water level, and the drainage requirement for the water accumulation tank 10*a* may not be satisfied through the first drain pipe 31. At this time, the controller is configured to control the drain pump 36 to be opened, to forcibly discharge the water through the drain pump 36 and the second drain pipe 32.

The controller may be configured to control the drain pump 36 to be opened while the water level in the water accumulation tank 10*a* reaches the first preset water level. That is, as long as the controller obtains information that the water level in the water accumulation tank 10*a* reaches the first preset water level, the controller is configured to control the drain pump 36 to be opened.

It will be appreciated that the controller may further be configured to control the drain pump 36 to be opened after the water level in the water accumulation tank 10*a* reaches the first preset water level for a first preset time. That is, when the controller obtains information that the water level in the water accumulation tank 10*a* reaches the first preset water level, and after the water level in the water accumulation tank 10*a* is higher than or at the first preset water level for the first preset time, the controller is configured to control the drain pump 36 to be opened. The first preset time may be set at a reasonable time, for example, 3 seconds, 5 seconds, etc. In this way, it is possible to effectively prevent the controller from misjudging, and to avoid the drain pump 36 from frequently starting and stopping.

In an embodiment, the controller is further configured to control the drain pump 36 to be closed when the water level in the water accumulation tank 10*a* is lower than a second preset water level. Herein, the second preset water level is higher than the height of the inlet of the first drain pipe 31, and the first preset water level is equal to or higher than the second preset water level. That is, the first preset water level may be the same as or different from the second preset water level. In one embodiment, the controller is configured to control the drain pump 36 to be opened when the water level in the water accumulation tank 10*a* is higher than the first preset water level. At this time, the water in the water accumulation tank 10*a* is discharged through the first drain pipe 31 and the second drain pipe 32, so that the water level in the water accumulation tank 10*a* falls. When the water level falls to the second preset water level, the controller may be configured to control the drain pump 36 to be closed, so that the water in the water accumulation tank 10*a* is discharged through the first drain pipe 31. In this way, it is possible to ensure the normal use of the laundry drying device 10, and to save energy and reduce consumption.

In order to avoid the drain pump 36 from frequently starting and stopping and to prevent the controller from misjudging, in an embodiment of the disclosure, the controller is configured to control the drain pump 36 to be closed or to be remained in the open state according to the water level in the water accumulation tank 10*a* after the drain pump 36 is opened for a second preset time. The second preset time is a single operation cycle of the drain pump 36, for example, 30 seconds, 35 seconds, etc. In one embodiment, when the controller is configured to control the drain pump 36 to be opened and the timing is started, and when the drain pump 36 is in the open state for the second preset time, the controller obtains the water level in the water accumulation tank 10*a* again. If the water level is higher than or equal to the second preset water level, the drain pump 36 continues to operate for another cycle, i.e., for the second preset time. If the water level is lower than the second preset water level, the controller is configured to control the drain pump 36 to be closed. During one operation cycle of the drain pump 36, regardless of whether the water level is lower than the second preset water level, the drain pump 36 is in the open state until one operation cycle of the drain pump 36 ends up.

In order to facilitate the detection of the water level in the water accumulation tank 10*a*, in an embodiment, the laundry treatment apparatus includes a liquid level detecting unit for detecting the water level in the water accumulation tank 10*a*. The liquid level detecting unit is electrically connected with the controller. The controller is configured to control the drain pump 36 to be opened or to be closed according to a detection result of the liquid level detecting unit. The specific type of the liquid level detecting unit is not limited, and the liquid level detecting unit may be of a contact type that needs to be in contact with liquid, for example, a single-flange static pressure transmitter, a double-flange differential pressure liquid level transmitter, a floating ball liquid level transmitter, a magnetic liquid level transmitter, an input liquid level transmitter, an electric inner floating ball liquid level transmitter, an electric float liquid level transmitter, a capacitive liquid level transmitter, a magnetostrictive liquid level transmitter, a servo liquid level transmitter, etc. The liquid level detecting unit may also be of a non-contact type that does not need to be in contact with the liquid, for example, an ultrasonic liquid level transmitter, a radar liquid level transmitter, etc.

In order to facilitate the first drain pipe 31 to discharge almost all the water in the water accumulation tank 10*a*, in an embodiment of the disclosure, the inlet of the first drain pipe 31 is located at a lowest position of the water accumulation tank 10*a*, so that the water flow in the water accumulation tank 10*a* can be substantially completely discharged through the first drain pipe 31 under the action of its own gravity.

It will be appreciated that a flow area of the second drain pipe 32 is greater than a flow area of the first drain pipe 31, so that the second drain pipe 32 can have a greater flow capacity during emergency drainage.

The laundry treatment apparatus of an embodiment of the disclosure may be a separate laundry dryer, i.e., only having a laundry drying function, or may be a combined laundry washer-dryer, i.e., including the laundry drying device 10 that performs the laundry drying function and a washing device 20 that performs a washing function, and the laundry drying device 10 and the washing device 20 are independent from each other.

In the embodiment of the disclosure, the laundry treatment apparatus is the combined laundry washer-dryer. In one embodiment, with reference to FIG. 1 and FIG. 2, the laundry treatment apparatus includes the washing device 20, a third drain pipe 33 and a main drain pipe 35. The washing device 20 is arranged below the laundry drying device 10, so that the overall structural layout of the laundry treatment apparatus is more reasonable. For example, the washing device 20 may have a large amount of water during the washing process, which greatly increases a weight of the washing device 20. Therefore, the washing device 20 is arranged below the laundry drying device 10, so that the laundry drying device 10 does not need to bear the weight of the washing device 20. On the one hand, the stress on the laundry drying device 10 can be reduced, and on the other hand, the washing device 20 with a relatively heavy weight is arranged below the laundry drying device 10, so that the stability of the laundry treatment apparatus can be increased.

Water in the washing device 20 is in communication with the main drain pipe 35 through the third drain pipe 33. The first drain pipe 31, the second drain pipe 32 and the third drain pipe 33 are in communication with the main drain pipe 35. That is, water in the first drain pipe 31, the second drain pipe 32 and the third drain pipe 33 is collected into the main drain pipe 35, and is discharged from the laundry treatment apparatus through the main drain pipe 35, so that the number of drain ports of the laundry treatment apparatus on the outer surface can be reduced, centralized drainage can be facilitated, and centralized pipe distribution in the laundry treatment apparatus can be facilitated.

The washing device 20 may be in an upper drainage mode or a lower drainage mode. In order to facilitate centralized pipe distribution, in an embodiment of the disclosure, the washing device 20 adopts the upper drainage mode.

Figure 3:
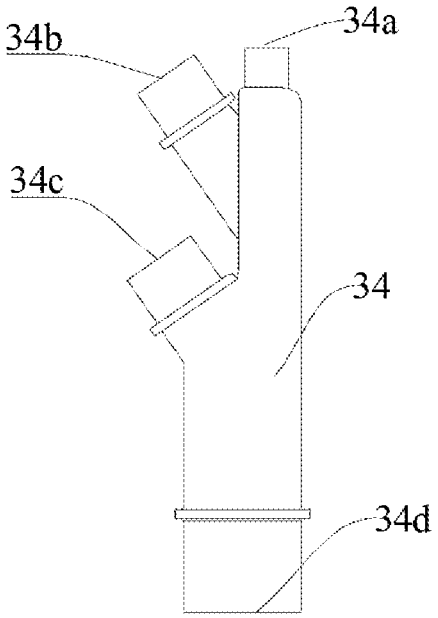
FIG. 3 is a schematic diagram of a multi-channel pipe according to an embodiment of the disclosure.
Figure 4:
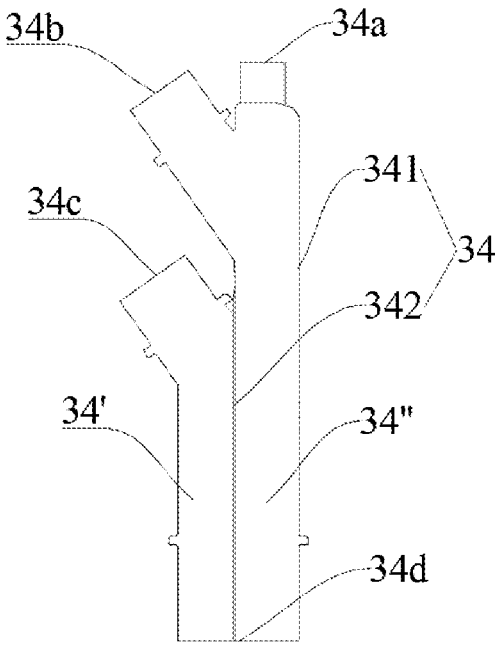
FIG. 4 is a cross-sectional view of the multi-channel pipe shown in FIG. 3.

In an embodiment, referring to FIG. 3 and FIG. 4, the laundry treatment apparatus includes a multi-channel pipe 34. The multi-channel pipe 34 includes a first inlet 34*a* connected with the first drain pipe 31, a second inlet 34*b* connected with the second drain pipe 32, a third inlet 34*c* connected with the third drain pipe 33, and a main outlet 34*d* connected with the main drain pipe 35. The multi-channel pipe 34 serves as a transitional connection to facilitate the transitional connection of the first drain pipe 31, the second drain pipe 32, the third drain pipe 33 and the main drain pipe 35.

The multi-channel pipe 34 may be a four-channel pipe, a five-channel pipe, or other pipe with more channels. Herein, a portion of the ports of the multi-channel pipe is closed, leaving only four ports as the first inlet 34*a*, the second inlet 34*b*, the third inlet 34*c* and the main outlet 34*d*, respectively.

Since a water pressure in the third drain pipe 33 is relatively high, in order to prevent the water in the third drain pipe 33 from flowing backward into the laundry drying device 10, in an embodiment of the disclosure, referring to FIG. 3 and FIG. 4, each of a height of the first inlet 34*a* and a height of the second inlet 34*b* is higher than a height of the third inlet 34*c*, so that there is a height difference between the water flow from the third drain pipe 33 and the first inlet 34*a* and the second inlet 34*b*, which increases the resistance of the water flow from the third drain port into the laundry drying device 10 through the first inlet 34*a* or the second inlet 34*b*, and reduces the possibility of the water flow in the third drain pipe 33 flowing backward into the laundry drying device 10.

In an embodiment, referring to FIG. 4, the multi-channel pipe includes a pipe body 341 and a partition plate 342 arranged in the pipe body 341. The first inlet 34*a*, the second inlet 34*b*, the third inlet 34*c* and the main outlet 34*d* are formed on the pipe body 341, and the liquid is circulated inside the pipe body 341. The partition plate 342 divides a space in the pipe body 341 into a first flow channel 34' and a second flow channel 34". The third inlet 34*c* forms an inlet of the first flow channel 34', and the first inlet 34*a* and the second inlet 34*b* form an inlet of the second flow channel 34". That is, the partition plate 342 separates the water flow from the third drain pipe 33 from the water flow from the first drain pipe 31 and the second drain pipe 32, and the first flow channel 34' and the second flow channel 34" converge at the end of the partition plate 342, which increases the height difference between the convergence and the first inlet 34*a* and the second inlet 34*b*, further increases the resistance of the water flow in the third drain pipe 33 flowing backward into the laundry drying device 10 through the first inlet 34*a* or the second inlet 34*b*, and further reduces the possibility of the water flow in the third drain pipe 33 flowing backward into the laundry drying device 10.

In an embodiment, the partition plate 342 extends to an end of the pipe body 341 connected with the main drain pipe 35. That is, the extension length of the partition plate 342 is extended as much as possible, to increase the height difference between the convergence and the first inlet 34*a* and the second inlet 34*b* as much as possible.

In an embodiment, the amount of drainage in the washing device 20 is relatively large, and the shape of the partition plate 342 remains arc-shaped, so that the cross-sectional shape of the first flow channel 34' is substantially circular, to increase the flow capacity of the first flow channel 34' and reduce the water flow resistance of the first flow channel 34' as much as possible.

In an embodiment, a flow area of the first flow channel 34' is greater than or equal to a flow area of the third drain pipe 33. In this way, after the water flow flows from the third drain pipe 33 into the first flow channel 34', the first flow channel 34' does not form a throttling effect, so that the water flow can smoothly enter the main drain pipe 35 through the multi-channel pipe 34.

In an embodiment, the multi-channel pipe 34 is located at the edge of the top of the washing device 20, for example, at the edge of the rear side of the washing device 20 away from the user. On the one hand, the upper drainage requirement for the third drain pipe 33 can be satisfied, and on the other hand, the multi-channel pipe 34 is located as much as possible at the junction of the washing device 20 and the laundry drying device 10 in a height direction, and the lengths of the first drain pipe 31 and the second drain pipe 32 are shortened as much as possible, so that centralized pipe distribution can be facilitated, and the pipe distribution structure of the laundry treatment apparatus can be more compact.

What is claimed is:

1. A laundry treatment apparatus, comprising:

a laundry drying device provided with a water accumulation tank;

a first drain pipe and a second drain pipe, an inlet of the first drain pipe being in communication with the water accumulation tank;

a drain pump including a water outlet and a water inlet, wherein the water outlet is in communication with the second drain pipe, and the water inlet is in communication with the water accumulation tank; and a controller configured to control the drain pump to be opened when a water level in the water accumulation tank is higher than a first preset water level, so that water in the water accumulation tank is discharged from the water accumulation tank through the first drain pipe and the second drain pipe, wherein the first preset water level is higher than a height of the inlet of the first drain pipe.

2. The laundry treating apparatus of claim 1, wherein the controller is configured to control the drain pump to be opened after the water level in the water accumulation tank reaches the first preset water level for a first preset time.

3. The laundry treating apparatus of claim 1, wherein the controller is configured to control the drain pump to be closed when the water level in the water accumulation tank is lower than a second preset water level, wherein the second preset water level is higher than the height of the inlet of the first drain pipe, and the first preset water level is equal to or higher than the second preset water level.

4. The laundry treating apparatus of claim 3, wherein the controller is further configured to control the drain pump to be closed or to be remained in an open state according to the water level in the water accumulation tank after the drain pump is opened for a second preset time.

5. The laundry treating apparatus of claim 1, wherein the inlet of the first drain pipe is located at a lowest position of the water accumulation tank.

6. The laundry treatment apparatus of claim 1, wherein a flow area of the second drain pipe is greater than a flow area of the first drain pipe.

7. The laundry treating apparatus of claim 1, wherein the laundry treatment apparatus comprises a liquid level detecting unit for detecting the water level in the water accumulation tank, the liquid level detecting unit is electrically connected with the controller, the controller is configured to control the drain pump to be opened or to be closed according to a detection result of the liquid level detecting unit.

8. The laundry treatment apparatus of claim 1, wherein the laundry treatment apparatus comprises a washing device, a third drain pipe and a main drain pipe, the main drain pipe is in communication with the first drain pipe, the second drain pipe, and the third drain pipe, the washing device is arranged below the laundry drying device, and water in the washing device is in communication with the main drain pipe through the third drain pipe, wherein the first drain pipe, the second drain pipe and the third drain pipe are in communication with the main drain pipe.

9. The laundry treatment apparatus of claim 8, wherein the laundry treatment apparatus comprises a multi-channel pipe, the multi-channel pipe comprises a first inlet connected with the first drain pipe, a second inlet connected with the second drain pipe, a third inlet connected with the third drain pipe, and a main outlet connected with the main drain pipe.

10. The laundry treatment apparatus of claim 9, wherein each of a height of the first inlet and a height of the second inlet is higher than a height of the third inlet.

11. The laundry treatment apparatus of claim 9, wherein the multi-channel pipe is located at an edge of a top of the washing device.

12. The laundry treatment apparatus of claim 9, wherein the multi-channel pipe comprises a pipe body and a partition plate arranged in the pipe body, the partition plate divides a space in the pipe body into a first flow channel and a second flow channel, the third inlet forms an inlet of the first flow channel, and the first inlet and the second inlet form an inlet of the second flow channel.

13. The laundry treatment apparatus of claim 12, wherein the partition plate extends to an end of the pipe body connected with the main drain pipe.

14. The laundry treatment apparatus according to claim 12, wherein a flow area of the first flow channel is greater than or equal to a flow area of the third drain pipe.

15. The laundry treatment apparatus according to claim 1, wherein the first drain pipe is in a normally open state, and the water accumulation tank is configured to always discharge water through the first drain pipe as long as a water level in the water accumulation tank is higher than a height of the inlet of the first drain pipe.

* * * * *